US010616680B2

(12) United States Patent
Bolsman et al.

(10) Patent No.: US 10,616,680 B2
(45) Date of Patent: Apr. 7, 2020

(54) RECEIVER ASSEMBLY

(71) Applicant: Sonion Nederland B.V., Hoofddorp (NL)

(72) Inventors: Caspar Titus Bolsman, Hoofddorp (NL); Raymond Mögelin, Hoofddorp (NL); Rasmus Voss, Hoofddorp (NL); Patrick Linthorst, Hoofddorp (NL); Andreas Tiefenau, Hoofddorp (NL); Nicolaas Maria Jozef Stoffels, Hoofddorp (NL); Peter Rietman, Hoofddorp (NL); Gerardus Johannes Franciscus Theodorus van der Beek, Hoofddorp (NL); Viktor Klymko, Hoofddorp (NL); Tomasz Grzeczynski, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 105 days.

(21) Appl. No.: 15/843,670

(22) Filed: Dec. 15, 2017

(65) Prior Publication Data

US 2018/0176678 A1 Jun. 21, 2018

(30) Foreign Application Priority Data

Dec. 16, 2016 (EP) ..... 16204740

(51) Int. Cl.
*H04R 1/00* (2006.01)
*H04R 1/28* (2006.01)
(Continued)

(52) U.S. Cl.
CPC ..... *H04R 1/2892* (2013.01); *H04R 1/08* (2013.01); *H04R 25/456* (2013.01); *H04R 25/604* (2013.01)

(58) Field of Classification Search
CPC ..... H04R 25/604; H04R 1/02; H04R 1/2892; H04R 2499/11
See application file for complete search history.

(56) References Cited

U.S. PATENT DOCUMENTS 3,019,306 A * 1/1962 Weiss ..... H04R 25/604 381/322
3,257,516 A 6/1966 Knowles
(Continued)

FOREIGN PATENT DOCUMENTS

EP 1248496 A2 10/2002
EP 1353531 A2 10/2003
(Continued)

OTHER PUBLICATIONS

Extended European Search Report in European Patent Application No. 16204740.1, dated Jun. 22, 2017 (3 pages).
(Continued)

*Primary Examiner* — Matthew A Eason
(74) *Attorney, Agent, or Firm* — Nixon Peabody LLP

(57) ABSTRACT

A receiver assembly including a receiver and an assembly housing. The receiver includes a sound outlet configured to outlet sound from the receiver. Furthermore, the receiver includes at least a first and a second outer surface and is arranged at least partly within the assembly housing. The assembly housing includes an assembly sound outlet arranged in communication with the sound outlet for outlet of sound from the receiver via the assembly outlet. The receiver assembly further includes a suspension structure having at least one suspension element, the suspension structure suspending the receiver in the assembly housing. The suspension element connects the receiver and the assembly housing, and the suspension element is formed by a sheet material and is an elongated element extending in an longitudinal direction and is configured to dampen vibration
(Continued)

of the receiver by deflection of the suspension element in a direction transverse to the longitudinal direction.

20 Claims, 13 Drawing Sheets

(51) Int. Cl.
*H04R 1/08* (2006.01)
*H04R 25/00* (2006.01)

(56) References Cited

U.S. PATENT DOCUMENTS 4,440,982 A * 4/1984 Kaanders ..... H04R 25/604 381/312
4,854,415 A * 8/1989 Goschke ..... H04R 25/60 181/130
6,459,800 B1 * 10/2002 Brimhall ..... H04R 25/604 181/171
6,788,796 B1 9/2004 Miles
6,831,577 B1 12/2004 Furst
6,853,290 B2 2/2005 Jorgensen
6,859,542 B2 2/2005 Johannsen
6,888,408 B2 5/2005 Furst
6,914,992 B1 7/2005 van Halteren
6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 Van Doorn
7,074,296 B2 * 7/2006 Vonlanthen ..... H04R 25/604 156/256
7,088,839 B2 8/2006 Geschiere
7,110,560 B2 9/2006 Stenberg
7,136,496 B2 11/2006 van Halteren
7,142,682 B2 11/2006 Mullenborn
7,181,035 B2 * 2/2007 van Halteren ..... H04R 25/65 381/322
7,190,803 B2 3/2007 van Halteren
7,206,428 B2 4/2007 Geschiere
7,221,767 B2 5/2007 Mullenborn
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,039 B2 1/2012 van Halteren
8,160,290 B2 4/2012 Jorgensen
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
9,578,429 B2 * 2/2017 Karamuk ..... H04R 25/604
10,405,085 B2 * 9/2019 Tiefenau ..... H04R 25/456
2003/0185412 A1 * 10/2003 Gebert ..... H04R 25/604 381/312
2009/0016553 A1 * 1/2009 Ho ..... H04R 25/604 381/324
2009/0161897 A1 6/2009 Fickweiler
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0255805 A1 10/2012 van Halteren
2013/0028451 A1 1/2013 de Roo
2013/0136284 A1 5/2013 van Hal
2013/0142370 A1 6/2013 Engbert
2013/0163799 A1 6/2013 van Halteren
2013/0195295 A1 8/2013 van Halteren
2015/0110328 A1 * 4/2015 Sondergaard ..... H04R 1/02 381/354
2018/0249253 A1 * 8/2018 Mao ..... H04R 9/02

FOREIGN PATENT DOCUMENTS

EP 2073572 A1 6/2009
EP 3051841 A1 8/2016
GB 2096863 A 10/1982
WO WO 01/43498 A1 6/2001
WO WO 02/05592 A2 1/2002
WO WO 2004/008803 A1 1/2004
WO WO 2004/049757 A1 6/2004
WO WO 2007/038897 A2 4/2007
WO WO 2012/062761 A1 5/2012

OTHER PUBLICATIONS

Extended European Search Report in European Patent Application No. 17207713.3, dated May 4, 2018 (4 pages).

* cited by examiner

RECEIVER ASSEMBLY

CROSS-REFERENCE TO RELATED APPLICATIONS

This application claims the benefit of European Patent Application Serial No. 16204740.1, filed Dec. 16, 2016, which is incorporated herein by reference in its entirety.

FIELD OF THE INVENTION

The present invention relates to a receiver assembly comprising a receiver and an assembly housing. The receiver assembly comprises a suspension structure suspending the receiver in the assembly housing to dampen vibration of the receiver.

BACKGROUND OF THE INVENTION

When producing sound, a receiver also creates vibrations. Such vibrations are unwanted and may put a limit on the performance of a personal audio device, such as a hearing aid. This is due to the fact that the vibrations can be picked up by the microphone and amplified again; i.e. feedback.

Prior art document EP 1 353 531 discloses a coil and a magnet assembly mounted on a printed circuit board (PCB). The PCB may be supported by the case. The use of the PCB provides a relatively rigid planar surface allowing precise positioning of the coil and magnet assembly.

EP 3 051 841 discloses a motor assembly attached to the receiver housing by a movable suspension structure to provide an internal balancing within the receiver itself.

WO 2007/038897 discloses an elastic and flexible holding element with inwardly projecting mounting areas for holding a component in position inside a housing. Movement is dampened by compression of the inwardly projecting areas made of rubber.

EP 1 248 496 discloses a mechanical suspension structure including a back and a front suspension. The back suspension includes a back contact structure, whereas the front suspension structure includes two front contact structures. Both the back suspension and the front suspension are made of an elastomeric material, e.g. silicone rubber.

SUMMARY OF INVENTION

It is an object of embodiments of the invention to provide an improved receiver assembly.

It is a further object of embodiments of the invention to provide a receiver assembly where vibration of the receiver is dampened.

According to a first aspect, the invention provides a receiver assembly comprising a receiver and an assembly housing;

- the receiver comprising a sound outlet configured to outlet sound from the receiver and at least a first and a second outer surface and being arranged at least partly within the assembly housing,
- the assembly housing comprising an assembly sound outlet arranged in communication with the sound outlet for outlet of sound from the receiver via the assembly outlet,
- the receiver assembly further comprising a suspension structure comprising at least one suspension element, the suspension structure suspending the receiver in the assembly housing,

- wherein the at least one suspension element connects the receiver and the assembly housing, the at least one suspension element being formed by a sheet material and being an elongated element extending in an longitudinal direction and being configured to dampen vibration of the receiver by deflection of the suspension element in a direction transverse to the longitudinal direction.

The receiver may be adapted to form part of any personal audio device, such as a hearing aid, such as a Behind-the-Ear (BTE) device, an In the Ear (ITE) device, a Receiver in the Canal (RIC) device, or any other personal audio device, such as headphones, earphones, and other earpieces. In the context of the present invention, the term "hearing aid" shall be understood as an electromagnetic device which is adapted to amplify and modulate sound and to output this sound to a user, such as into the ear canal of a user.

Thus, the receiver may be adapted to receive an electrical signal and output a corresponding audio signal through the sound outlet.

The receiver may comprise a magnet assembly and an armature. The magnet assembly may be arranged to provide a magnetic field in an air gap, and the armature may comprise at least one leg which extends through the air gap.

The armature may be made from any type of material, element and/or assembly able to guide or carry a magnetic flux. The armature may be electrically conducting or not.

The receiver may further comprise a diaphragm which is operationally attached to the armature, such that movement of the armature is transferred to the diaphragm. It will be appreciated that movement of the diaphragm causes sound waves to be generated. In one embodiment, the diaphragm is operationally attached to the armature by means of a diaphragm connecting member, such as a drive pin. Alternatively, the diaphragm may itself be attached to the armature.

The diaphragm may comprise a plastic material, such as a polymer, or alternatively a metal material such as aluminium, nickel, stainless steel, or any other similar material. It should however be understood, that the diaphragm may comprise a plurality of materials. The diaphragm may divide the chamber into two chambers, such as a front volume and a back volume.

It should be understood, that the receiver in one embodiment may be a balanced armature receiver, whereas the receiver in other embodiments may also comprise other transducer technologies, such as e.g. piezo technology, moving coil, electrostatic receiver technologies, and microphones, such as electret, MEMS, etc.

It should further be understood, that the assembly may comprise more than one receiver, such as two, three, or more receivers. Assemblies comprising more than one receiver may as an example comprise receivers of a single type, such as two balanced armature receivers, or may alternatively comprise receivers of different types, such as a balanced armature receiver and an electrostatic receiver.

The assembly housing may be located in a shell made of a soft material, such as silicone, thereby improving the comfort. To improve comfort further, an individual shell may be made for each user to fit the ear of the user.

The sound outlet of the receiver is arranged in communication with the assembly outlet for outlet of sound from the receiver via the assembly sound outlet.

The receiver may be formed as a substantially box-shaped element. Other shaped may however also be applicable.

The assembly housing may likewise be formed as a substantially box-shaped element. However, other shapes may also be applicable, such as shapes which fit the ear of a user.

The receiver is arranged at least partly within the assembly housing. Thus, the receiver may have an outer surface facing toward an inner surface of the assembly housing. The inner and outer surfaces may each comprise a first surface, a second surface, a third surface, and even more surface. As an example, a substantially box-shaped receiver may comprise six outer surfaces.

If the receiver and/or assembly housing is substantially box-shaped it should be understood, that the edges and corners may be rounded off. This may also be the case for receivers and assembly housings in other shapes.

The receiver assembly further comprises a suspension structure comprising at least one suspension element. The suspension structure is arranged to suspend the receiver in the assembly housing. The at least one suspension element connects the receiver and the assembly housing.

In the context of the present invention, the term "connects" not only covers embodiments where the suspension element is in contact with the receiver and the assembly housing. The suspension element may also connect the receiver and the assembly housing by being in contact with the receiver and the assembly housing via at least one additional element. It should further be understood, that the term "connects" both covers embodiment were the suspension element is contact with the receiver and/or the assembly housing and embodiment where the suspension element is attached to the receiver and/or the assembly housing.

The at least one suspension element is an elongated element extending in an longitudinal direction and is configured to dampen vibration of the receiver by deflection of the suspension element in a direction transverse to the longitudinal direction. As an example, the suspension element may comprise at least one leaf spring.

In the context of the present invention, the term "dampen vibration" should be understood as reducing vibration by decoupling the receiver from the assembly housing. It should be understood, that some vibration may still be present.

In the context of the present invention, the term "in a direction transverse to the longitudinal direction" should be understood as a direction perpendicular to the longitudinal direction and directions in the range of +/−80 degrees relative to perpendicular.

The at least one suspension element may have a thickness being a distance from one side of the suspension element to the opposite side of the suspension element substantially in the deflection direction. Furthermore, the at least one suspension element may have a width being transverse to the length and to the thickness. Typically, the thickness is the smallest dimension of the elongated element, whereas the length typically is the largest dimension of the elongated element. The length will typically be substantially larger than the thickness.

The suspension element may be made of metal, polymer, fibre reinforced plastic, multilayer composites, or combinations hereof, etc.

The at least one suspension element is formed by a sheet material; i.e. by thin, flat pieces of the required material, e.g. by flattened metal. By providing the at least one suspension element of a sheet material, it may be achieved that the space required to accommodate the suspension element may be considerably smaller than the space required for a suspension formed by a solid rubber element being arranged to provide a dampening effect in the range of the present invention.

The thickness of the at least one suspension element may be in the range of 0.01-0.25 mm. It should be understood that the thickness may vary along the length of the suspension element to thereby vary the ability of deflection along the length of the suspension element.

In one embodiment, a cross-section of the elongated element may be non-uniform along at least a part of elongated element in the longitudinal direction. Thus, the width of the at least one suspension element may vary along at least a part of the length of the element to thereby provide a non-uniform ability of deflection along the length of the suspension element.

By providing the suspension structure comprising at least one suspension element with varying width or comprising at least one suspension element having a width being smaller than at least a second suspension element with a larger width, it may be possible to tune the stiffness of the suspension structure, and thus the compliance to thereby vary the capability of dampen vibration.

It should be understood, that a plurality of suspension elements may be attached to each other by welding, gluing, or by other means. However, it should further be understood, that a plurality of suspension elements may not be attached to each other. In one embodiment, a plurality of suspension elements may be joined solely by pressing them together, as they may be arranged so that they are firmly fixed, e.g. at an end point, in the assembly housing.

The at least one suspension elements connect the receiver and the assembly housing by being attached to at least one of the receiver and the assembly housing by welding, gluing, or by other means. However, it should further be understood, that the at least one suspension element may be arranged so that it firmly fixed, e.g. at an end point, in the assembly housing.

Vibrations created by the receiver during the production of sound may thus be dampened by deflection of the at least one suspension element in a direction transverse to the longitudinal direction hereof. Furthermore, by deflection of the at least one suspension element it may be achieved that the receiver assembly operates above resonance frequency whereby the receiver may be decoupled from the assembly housing.

Due to the application of a suspension structure comprising a deflectable suspension element the receiver is movable arranged in the assembly housing whereby vibrations may be effectively decoupled.

To improve the efficiency of the at least one suspension element and thereby increase the dampening effect, the at least one suspension element may be in contact with an outer surface of the receiver at one end point and an inner surface of the assembly housing at the other end point to allow deflection of the suspension element between the end points. It should be understood, that the end points may be arranged at a distance to the opposite ends terminating of the elongated element, whereby at least one of the end points may be arranged in the area of the ends terminating the elongated elements.

By providing the least one suspension element in contact with an outer surface of the receiver at one end point and an inner surface of the assembly housing at the other end point, the distance from the suspension element to the receiver may vary along length of the elongated element, thereby facilitating deflection of the suspension element.

To be able to dampen vibration in more than one direction, two suspension elements may be arranged on two different sides of the receiver; i.e. one at each side. Alternatively or additionally, a suspension structure may form a bent section whereby a first suspension element can be arranged between a first outer surface of the receiver and an inner surface of the assembly housing and a second suspension element can be arranged between a second outer surface of the receiver and an inner surface of the assembly housing. The first and second suspension elements may extend in different directions from the bent part thereby providing a 2D suspension structure, and the bent section may be arranged at an edge of the receiver. Thus, the first and second suspension element may be arranged in series.

To be able to dampen vibration in more than two directions, three suspension elements may be arranged on three different sides of the receiver; i.e. one at each side, or one at one side and a suspension structure comprising a bent section arranged with a first suspension element at one side and a second suspension element at another side. Alternatively or additionally, a suspension structure may form a second bent section so that a third suspension element can be arranged between a third outer surface of the receiver and an inner surface of the assembly housing thereby providing a 3D suspension structure.

In embodiments comprising a 3D suspension structure; i.e. a suspension structure comprising at least one elongated element with a bend section and/or a plurality of elongated elements whereby a suspension elements is arranged along three different sides of the receiver, the stiffness and thus the compliance may be different in three directions if the width of at least some of the suspension element are different thereby enabling tuning of the stiffness in these three directions.

The receiver assembly may further comprise a deformable element arranged between the suspension element and the receiver whereby the suspension element contacts the receiver at least partly via the deformable element. The deformable element may be a dampening gel, a foam, or another material suitable to dampen vibration. The deformable element may be especially suitable for decoupling at low frequencies, as more energy is dissipated, thereby resulting in less transfer. Furthermore, it may be especially suitable for dampening in a direction transverse to the surface onto which it is arranged.

In an alternative embodiment, the deformable element may be arranged between the suspension element and the assembly housing.

To facilitate fixing of a suspension element in the assembly housing, a protrusion may be formed on the outer surface of the receiver, such as on the first outer surface or the second outer surface. The suspension element may contact the receiver at least partly at the protrusion. One end point of the suspension element may be attached to or may contact the protrusion and another end of the suspension may be attached to or may contact the inner surface of the assembly housing.

By arranging the sound outlet in communication with the assembly outlet, vibrations from the receiver may be transferred to the assembly housing. To reduce the risk of transferring such vibrations, the receiver assembly may further comprise a vibration dampening element connecting the sound outlet and the assembly sound outlet. The vibration dampening element may be compliant to enable reduction of vibrations.

In one embodiment, the vibration dampening element is compliant in at least two directions.

In the context of the present invention, the term "connects" not only covers embodiments where the vibration dampening element is in contact with the receiver and the assembly housing. The vibration dampening element may also connect the sound outlet and the assembly sound outlet by being in contact with the receiver and the assembly housing via at least one additional element.

The vibration dampening element may be more compliant in the direction of the sound outlet that in directions transverse to the sound outlet. This may be particularly interesting for receivers which primarily produce vibrations in the direction of the sound outlet, such as a dual receiver. However, is should be understood, that the vibration dampening element may in an alternative embodiment be substantially equally compliant in at least two directions.

The vibration dampening element may comprise at least one through hole allowing sound to propagate through the vibration dampening element.

The vibration dampening element may seal a passage between the sound outlet and the assembly sound outlet in order to facilitate outlet of sound from the receiver via the assembly outlet.

In one embodiment this may be achieved by arranging the vibration dampening element so that it seals a passage between an outer surface of one sound outlet and the assembly sound outlet and an inner surface of the other one of the sound outlet and the assembly sound outlet.

In one example, the sound outlet and the assembly sound outlet are provided as two elongated sound channels. The diameter of one of these sound channels may be smaller than the diameter of the other one of the sound channel to facilitate insertion of one sound channel at least partly into the other sound channel. In this embodiment the vibration dampening element may be arranged circumferential around the smaller sound channel and circumferential along the inner surface of the other sound channel, thereby sealing the passage between the two sound outlets.

It should be understood that the sound outlet, the assembly sound outlet, and the sound channels may have a circular cross-section. However, other cross-sectional shapes may also be applied. As an example, the cross-section may be oval or rectangular, or of any other arbitrary shape.

In an alternative embodiment, the vibration dampening element forms a sound channel from the sound outlet to the assembly sound outlet. In this embodiment the vibration dampening element may be attached directly to the receiver and to the assembly housing. It should however be understood, that the vibration dampening element may be attached to at least one of the receiver and the assembly housing via one or more connecting element, e.g. to facilitate connection hereof.

The vibration dampening element may as an example be formed by a polymer material or by a metal, or combinations hereof. In one embodiment, the vibration dampening element may be made of an elastic foil, such as a thin rubbery foil to thereby achieve sufficient compliance.

By providing the suspension structure and the vibration dampening element for the sound outlet as separate elements, these elements may be individually optimised leading to a more optimal system which covers both vibration dampening relating to the positioning of the receiver in the assembly housing and relating to outlet of sound from the receiver via the sound outlet and the assembly sound outlet.

The receiver assembly may further comprise a compressible dampening element arranged between an outer surface of the receiver and an inner surface of the assembly housing to dampen vibration of the receiver, as vibration may be dampened by compression of the element.

The compressible dampening element may in one embodiment comprise a substantially flat base element having a plurality of deformable protrusions extending toward at least one of an outer surface of the receiver and an inner surface of the assembly housing.

As an example, the substantially flat base may be attached to the outer surface of the receiver by gluing, whereby the deformable protrusions may extend toward an inner surface of the assembly housing and may be in contact herewith. It should be understood, that the substantially flat base element may likewise be attached to the inner surface of the assembly housing whereby the deformable protrusions may extend toward the outer surface of the receiver.

The substantially flat base element may facilitate attachment of the compressible dampening element, as it can easily be arranged at an outer surface of the receiver due to the size and shape hereof. To further facilitate attachment of the compressible dampening element, the base element may be stiff, e.g. by providing it of metal, whereas the deformable protrusions may as an example be made of a polymer.

The dampening performance of the compressible dampening element may be changed by changing at least one of the size, shape, and position/pattern of the deformable protrusions.

The compressible dampening element may further act as shock protection. This may be achieved by providing some of the protrusions of a smaller height whereby there is no contact between the smaller protrusions and the inner surface of the assembly housing. To improve the shock protecting effect, these smaller protrusions may be filled with a dampening material, such as a dampening gel or a foam.

It should further be understood, that the deformable protrusions may be hollow or solid. In one embodiment, both hollow and solid protrusions may be present.

The receiver assembly may further comprise a pre-tensioned element suspended between an outer surface of the receiver and an inner surface of the assembly housing. By using a pre-tensioned suspension element, the receiver may be compliantly suspended. Furthermore, the pre-tensioned element may be substantially flat thereby only taking up little space in the assembly housing. As the pre-tensioned suspension elements may be provided at different width, it may be possible to change the stiffness of the suspension and thereby adapt the vibration dampening effect to e.g. different types and/or sizes of receivers.

The at least one suspension element may be arranged so that it forms at least a first and a second chamber in the assembly housing, when the suspension element contacts both an inner surface of the assembly housing and an outer surface of the receiver. To decrease the vibration peaks, the receiver assembly may further comprise a vent arranged in communication with the first and second chamber. Furthermore, the vent may increase the output of the receiver.

In an alternative embodiment, the vent may be arranged in communication with one of the first and second chambers and with the outside; i.e. outside the assembly housing.

Traditionally, power is transferred from outside the receiver to the receiver by use of normal wires, such as solid or litz wires. In order let the receiver move within the receiver housing, the wires are provided at additional length, whereby one or more slack loops may be present in the assembly housing.

Effective vibration dampening may depend on the total mechanical connection path between the receiver and the assembly housing. Consequently, also the wires may contribute to the vibration performance of the receiver assembly.

To improve the vibration dampening effect, at least one of the suspension elements may be electrically conductive and may be arranged between an electrical connector of the receiver and an electrical connector of the assembly housing.

As an example, a flex print may be used as a suspension element to enable both mechanical and electrical connection between the receiver and the assembly housing.

As the receiver assembly may be exposed to mechanical shocks, e.g. if dropped on the floor, it may be an advantage if the receiver assembly further comprises a shock protection element arranged in the assembly housing, as this may protect the receiver from impact from the assembly housing. The shock protection element may have a higher compliance than the vibration dampening element. By providing the suspension structure and the shock protection as separate elements, these elements may be individually optimised leading to a more optimal system which covers both vibration dampening and shock protection.

Thus, it may be possible to provide an optimised system in which the suspension structure, the vibration dampening element for the sound outlet, and the shock protection are provided as separate elements which can be individually optimised.

To ensure sufficient efficiency, the shock protection element may be made of a soft material such as a foam. The shock protection effect may be achieved by a combination of the physical properties and the dimensions of the shock protection element. As an example, a shock protection element in the form of a foam with micro pores provided at a thickness of 0.4 mm may provide the same shock protection as a shock protection element of latex; i.e. a polymer, provided at a thickness of 0.25 mm, since these shock protection elements have the same mechanical stiffness due to the combination of their mechanical properties and dimensions.

It should be understood that other materials and/or thicknesses and/or combinations of materials and/or thicknesses may also be possible.

The shock protection element may be attached to at least one of an outer surface of the receiver and an inner surface of the assembly housing. The shock protection element may only be in contact with one of the receiver and the assembly housing. However, during a mechanical shock it may touch both the receiver and the assembly housing to thereby lower the impact of a shock.

It should be understood, that the receiver assembly may comprise a plurality of shock protection elements. As an example, a shock protection element may be arranged on each side of the receiver to protect the receiver from impact on each side.

In one embodiment, the receiver may comprise an additional sound outlet, and the assembly housing may comprise an additional assembly sound outlet, where the additional sound outlet is arranged in communication with the additional assembly sound outlet for outlet of sound from the receiver via the additional assembly sound outlet. The receiver may be a module of two receivers or a dual receiver with two sound outlets.

It should be understood, that the receiver may be traditional dual receiver with a common sound outlet, where the common sound outlet of the dual receiver forms the sound outlet.

In one embodiment, the receiver assembly may further comprise an additional receiver comprising an additional sound outlet and a joiner. The joiner may comprise a spout portion forming at least one sound channel extending through the spout portion and a mounting plate portion having a first surface and an opposite second surface. The mounting plate portion may comprise first engagement means for engaging the receiver at the first surface, and second engagement means for engaging the additional receiver at the second surface. When arranging the receiver and the additional receiver on opposite sides of the mounting plate portion, the sound outlet and the additional sound outlet can be aligned with one of the at least one sound channels extending through the spout portion.

By use of a joiner assembling, positioning and alignment of the receiver and the additional receiver may be facilitated and may in some embodiments even be carried out without the use of additional fixture elements.

According to a second aspect, the invention provides a personal audio device comprising a receiver assembly according to the first aspect of the invention, wherein the receiver is configured to generate sound whereby it vibrates within a frequency range of 10 Hz-20 kHz, and wherein the at least one suspension element is configured to deflect to thereby dampen vibration of the receiver.

The frequency range may depend on the type of personal audio device in which the receiver is used.

It should be understood, that a skilled person would readily recognise that any feature described in combination with the first aspect of the invention could also be combined with the second aspect of the invention, and vice versa.

The receiver assembly according to the first aspect of the invention is very suitable for the person audio device according to the second aspect of the invention. The remarks set forth above in relation to the receiver assembly are therefore equally applicable in relation to the personal audio device.

According to a third aspect, the invention provides a receiver assembly comprising a receiver and an assembly housing;

the receiver being arranged at least partly within the assembly housing and comprising a sound outlet configured to outlet sound from the receiver, the assembly housing comprising an assembly sound outlet arranged in communication with the sound outlet for outlet of sound from the receiver via the assembly outlet, the receiver assembly further comprising a compressible dampening element arranged between an outer surface of the receiver and an inner surface of the assembly housing.

The compressible element may comprise a substantially flat base element having a plurality of deformable protrusions extending toward at least one of an outer surface of the receiver and an inner surface of the assembly housing. The deformable protrusions may be hollow or solid. In one embodiment, both hollow and solid protrusions may be present.

According to a fourth aspect, the invention provides a receiver assembly comprising a receiver and an assembly housing;

the receiver being arranged at least partly within the assembly housing and comprising a sound outlet configured to outlet sound from the receiver, the assembly housing comprising an assembly sound outlet arranged in communication with the sound outlet for outlet of sound from the receiver via the assembly outlet, the receiver assembly further comprising a pre-tensioned element suspended between an outer surface of the receiver and an inner surface of the assembly housing.

According to a fifth aspect, the invention provides a receiver assembly comprising a receiver and an assembly housing;

the receiver arranged at least partly within the assembly housing and comprising a sound outlet configured to outlet sound from the receiver, the assembly housing comprising an assembly sound outlet arranged in communication with the sound outlet for outlet of sound from the receiver via the assembly outlet, the receiver assembly further comprising a suspension structure comprising at least one suspension element, the suspension structure suspending the receiver in the assembly housing, wherein the suspension elements forms at least a first and a second chamber in the assembly housing, the receiver assembly further comprising a vent arranged in communication with the first and second chamber.

According to a sixth aspect, the invention provides a receiver assembly comprising a receiver and an assembly housing;

the receiver being arranged at least partly within the assembly housing and comprising a sound outlet configured to outlet sound from the receiver, the assembly housing comprising an assembly sound outlet arranged in communication with the sound outlet for outlet of sound from the receiver via the assembly outlet, the receiver assembly further comprising a suspension structure comprising at least one suspension element, the suspension structure suspending the receiver in the assembly housing, wherein at least one of the suspension elements is electrically conductive and arranged between an electrical connector of the receiver and an electrical connector of the assembly housing.

It should be understood, that a skilled person would readily recognise that any feature described in combination with the first aspect of the invention could also be combined with the any of the third, fourth, fifth, and sixth aspects of the invention, and vice versa.

The remarks set forth above in relation to the receiver assembly according to the first aspect of the invention are therefore equally applicable in relation to any of the third, fourth, fifth, and sixth aspects of the invention.

Furthermore, the features of any of the third, fourth, fifth, and sixth aspects of the invention are applicable in relation to any of the first, second, third, fourth, fifth, and sixth aspects of the invention.

BRIEF DESCRIPTION OF THE DRAWINGS

Embodiments of the invention will now be further described with reference to the drawings, in which.

DETAILED DESCRIPTION OF THE INVENTION

It should be understood that the detailed description and specific examples, while indicating embodiments of the invention, are given by way of illustration only, since various changes and modifications within the spirit and scope of the invention will become apparent to those skilled in the art from this detailed description.

Figure 1:
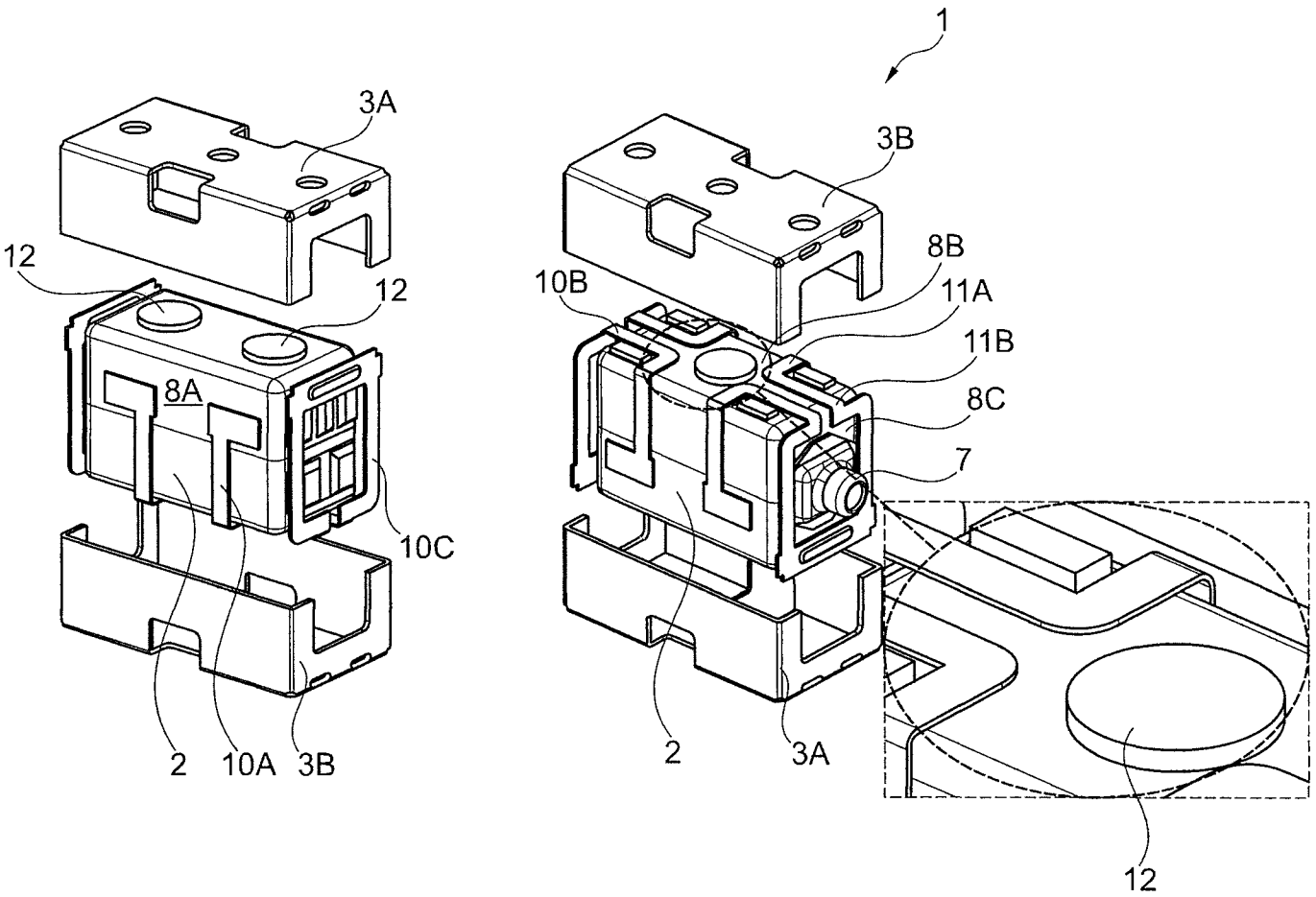
FIG. 1 illustrates an embodiment of a receiver assembly.

FIG. 1 illustrates an embodiment of a receiver assembly 1 in an exploded view. The illustration to the left is an upside-down view of the illustration in the middle. Furthermore, it is rotated 180 degrees.

The receiver assembly 1 comprises a receiver 2 and an assembly housing 3. The assembly housing 3 is formed by an upper section 3A and a lower section 3B.

The receiver 2 comprises a magnet assembly 4 (see FIG. 5D), an armature 5 (see FIG. 5D), a diaphragm 6 (see FIG. 5D) being operationally attached to the armature, and a sound outlet 7 configured to outlet sound from the receiver 2. It should be understood, that other types of receivers are equally applicable for the invention.

The receiver 2 comprises an outer surface 8; i.e. at least a first 8A, a second outer surface 8B, and a third outer surface 8C. The receiver 8 is arranged at least partly within the assembly housing 3.

The assembly housing 3 comprises an assembly sound outlet 9 (see e.g. FIG. 3 and FIG. 5A) arranged in communication with the sound outlet 7 for outlet of sound from the receiver 2 via the assembly outlet 9.

The receiver assembly 1 further comprises two suspension structures 10 each comprising three suspension elements 10A, 10B, 10C. The suspension structures 10 suspend the receiver 2 in the assembly housing 3. Each suspension element 10 connects the receiver 2 and the assembly housing 3.

Each suspension element 10 is an elongated element extending in a longitudinal direction and is configured to dampen vibration of the receiver 2 by deflection of the suspension element 10 in a direction transverse to the longitudinal direction.

As illustrated, the elongated suspension element 10 may comprise additional elements transverse to the elongated part.

In the illustrated embodiment, the suspension structure 10 forms two bent sections 11 whereby a first suspension element 10A is arranged between the first outer surface 8A and an inner surface of the assembly housing 3, a second suspension element 8B is arranged between the second outer surface 8B and an inner surface of the assembly housing, and third the suspension element 10C is arranged between a third outer surface 8C and an inner surface of the assembly housing 3. The first 10A and second 10B suspension elements extend in different directions from the bent part 11A, whereas the second 10B and third 10C suspension elements extend in different directions from the bent part 11B.

The illustrated suspension structure 10 thereby forms a 3D structure enabling dampening of vibration in three different directions relative to the receiver 2.

The receiver assembly 1 further comprises shock protection elements 12 arranged in the assembly housing 3, as this may protect the receiver 2 from impact from the assembly housing 3, e.g. if the receiver assembly 1 is dropped. The shock protection element 12 is made of a soft material, such as a foam.

Figure 2A:
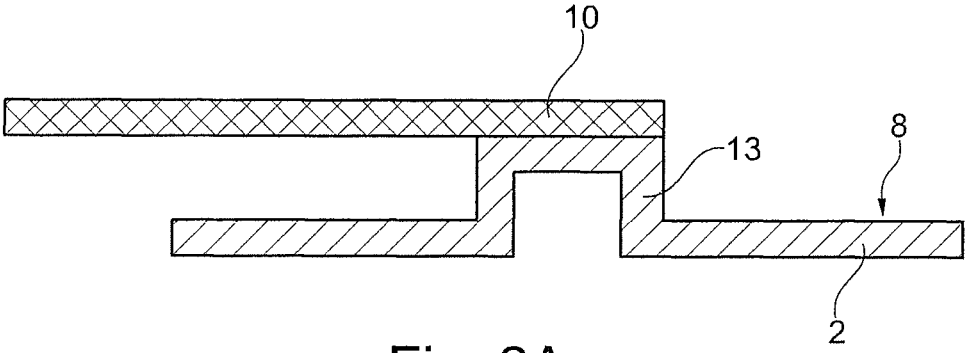
FIGS. 2A-2D illustrate different ways of contact between a suspension element and a receiver.

FIGS. 2A-2D illustrate different ways of contact between a suspension element 10 and a receiver 2. In FIG. 2A, a protrusion 13 is formed on the outer surface 8 of the receiver 2. The suspension element 10 contacts the receiver 2 at the protrusion 13.

Figure 2B:
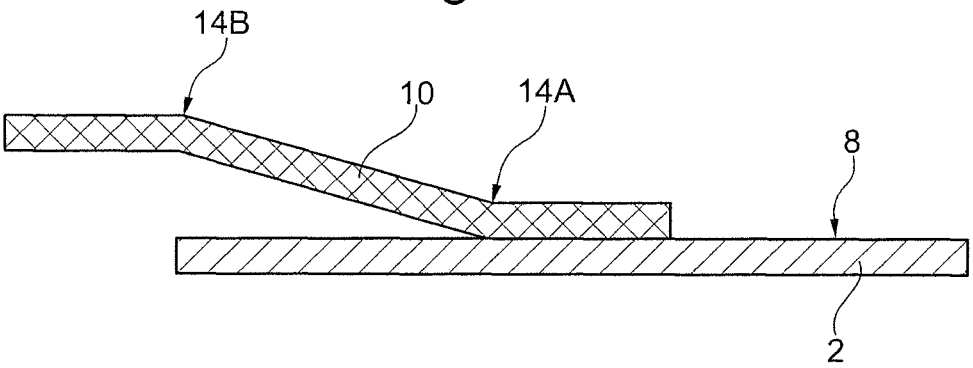

In FIG. 2B, the suspension element 10 comprises two bent sections 14A, 14B to fix the suspension element 10 between the outer surface 8 of the receiver 2 and an inner surface of the assembly housing (not shown).

Figure 2C:
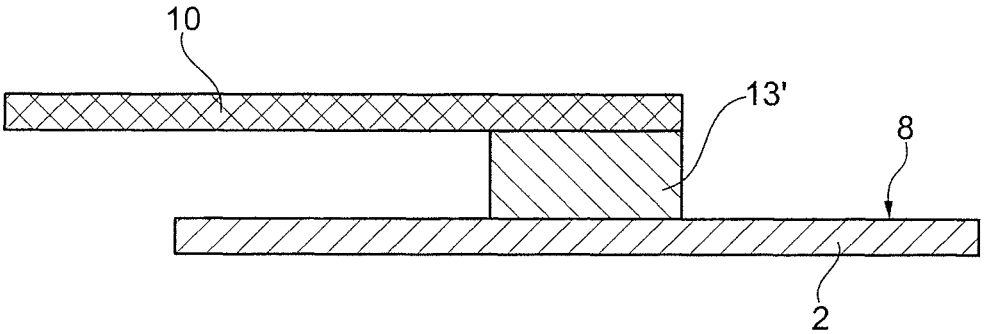

In FIG. 2C, a protrusion 13' is formed on the outer surface 8 of the receiver 2. The suspension element 10 contacts the receiver 2 at the protrusion 13'. In FIG. 2C, the protrusion 13' is formed as a separate element connected to the outer surface 8, whereas the protrusion 13 of FIG. 2A forms part of the outer surface 8.

Figure 2D:
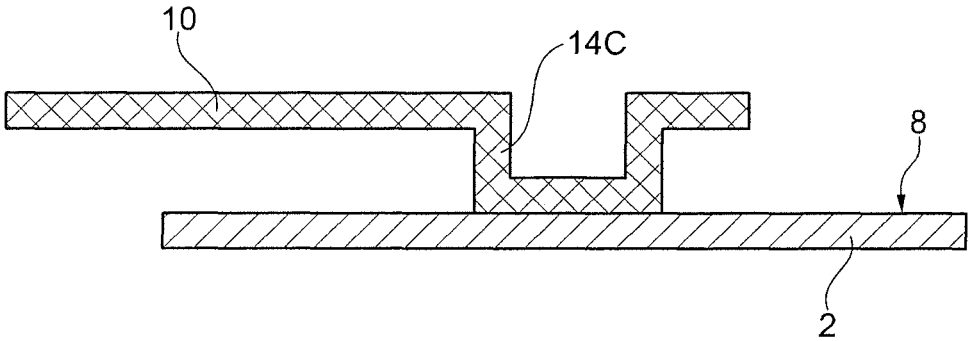

In FIG. 2D, the suspension element 10 comprises an indentation 14C to fix the suspension element 10 between the outer surface 8 of the receiver 2 and an inner surface of the assembly housing (not shown).

Figure 3A:
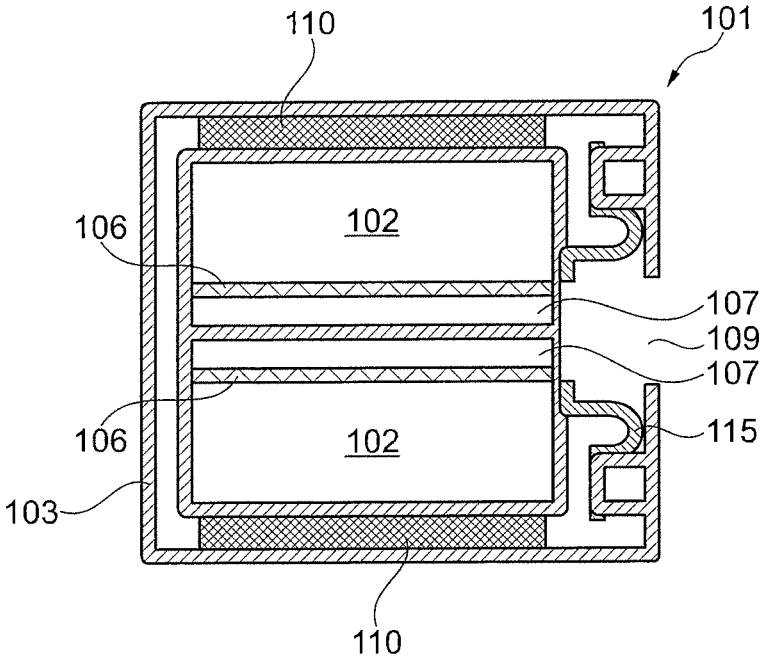
FIGS. 3A and 3B illustrate different embodiments of a receiver assembly.
Figure 3B:
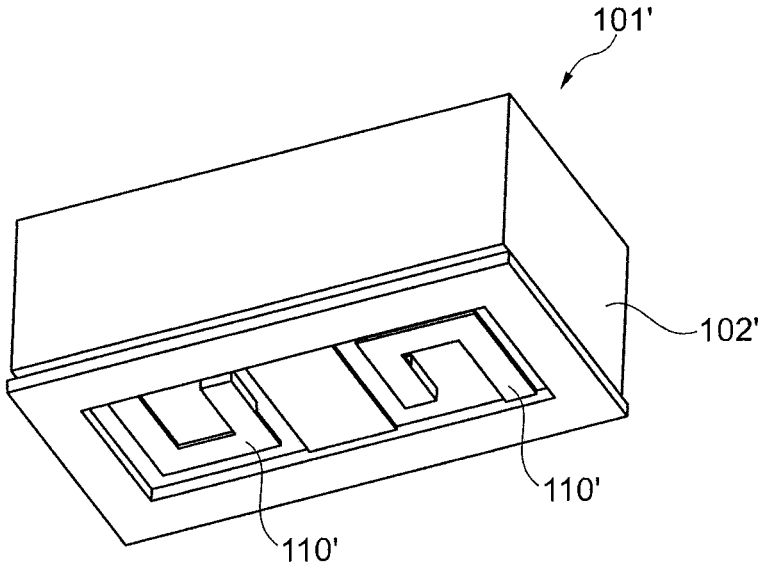

FIGS. 3A and 3B illustrate different embodiments of a receiver assembly 101, 101' comprising a receiver 102, 102' and an assembly housing 103.

The receiver assembly 101 further comprises two suspension structures 110, 110'. The suspension structures 110, 110' suspend the receiver 102, 102' in the assembly housing 103.

As illustrated in FIG. 3B, the elongated suspension element 110' may comprise additional elements transverse to the elongated part.

The illustrated suspension structure 110, 110' forms a 1D structure enabling dampening of vibration in one direction relative to the receiver 102, 102'.

The receiver assembly 101 comprises a vibration dampening element 115 connecting the sound outlet 107 and the assembly sound outlet 109. The vibration dampening element 115 is compliant to enable reduction of vibrations.

In the illustrated embodiment, the vibration dampening element 115 forms a sound channel from the sound outlet 107 to the assembly sound outlet. The vibration dampening element 115 is attached to the receiver 202 and to the assembly housing 203.

Figure 4:
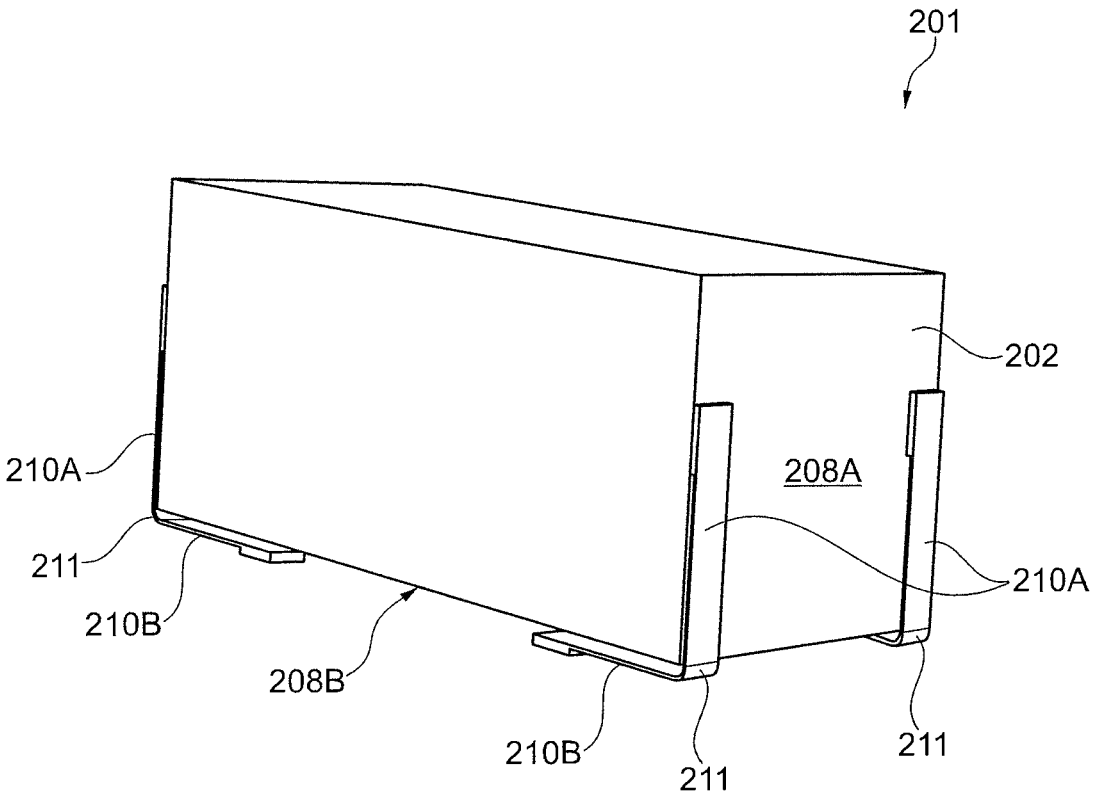
FIG. 4 illustrates an embodiment of a receiver assembly.

FIG. 4 illustrates parts of an embodiment of a receiver assembly 201 comprising a receiver 202 and an assembly housing (not shown).

The receiver assembly 201 further comprises four suspension structures 210. The suspension structures 210 suspend the receiver 202 in the assembly housing (not shown).

The suspension structures 210 each forms two bent sections 211 whereby a first suspension element 210A is arranged between the first outer surface 208A and an inner surface of the assembly housing, and a second suspension element 208B is arranged between the second outer surface 208B and an inner surface of the assembly housing.

The illustrated suspension structures 210 thereby each forms a 2D structure enabling dampening of vibration in two directions relative to the receiver 202.

Figure 5A:
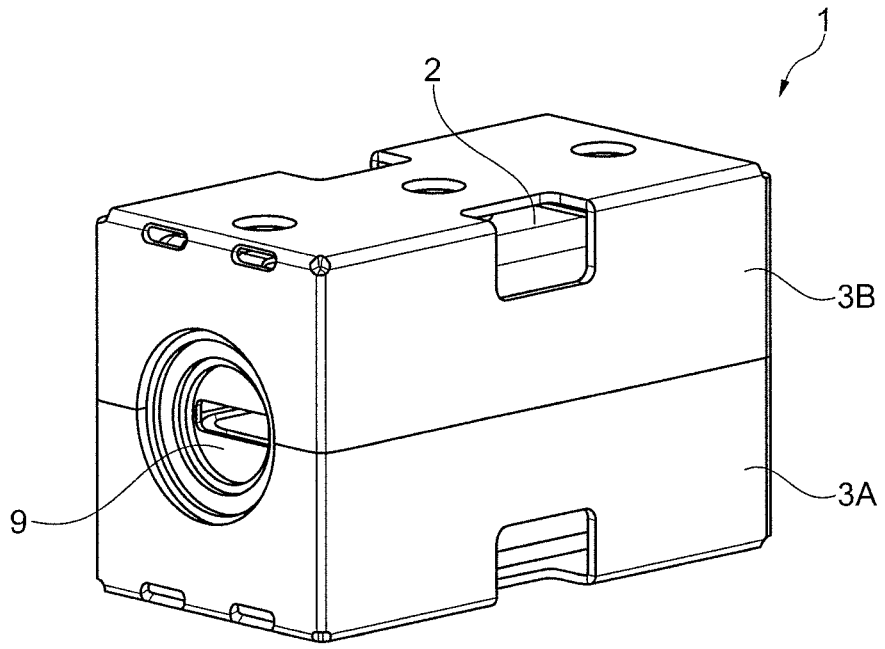
FIGS. 5A-5D illustrate different views of an embodiment of a receiver assembly.

FIGS. 5A-5D illustrate different views of the embodiment of a receiver assembly 1 also illustrated in FIG. 1. In FIG. 5A, the two sections 3A, 3B of the assembly housing 3 are closed around the receiver 2 and the suspension structure 10.

Figure 5B:
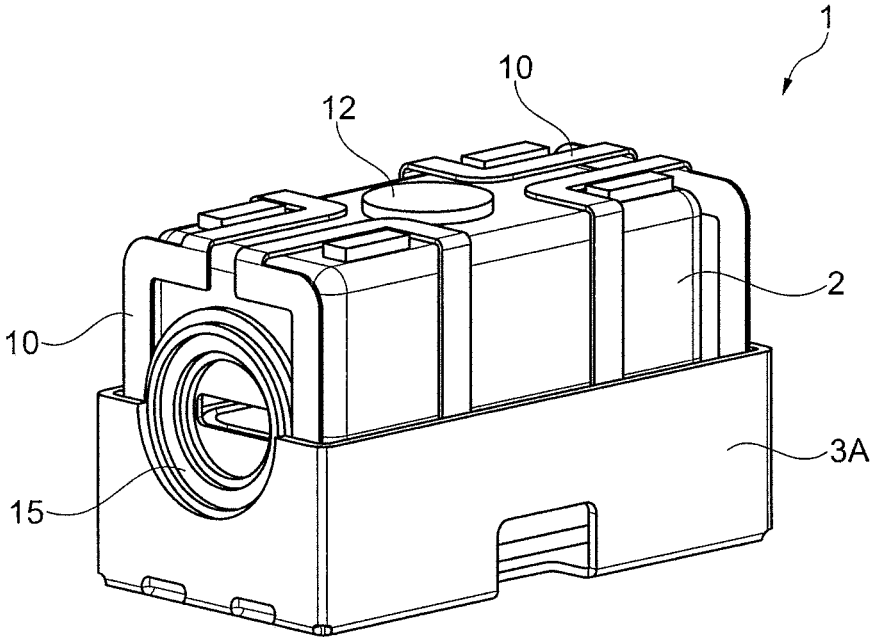
Figure 5C:
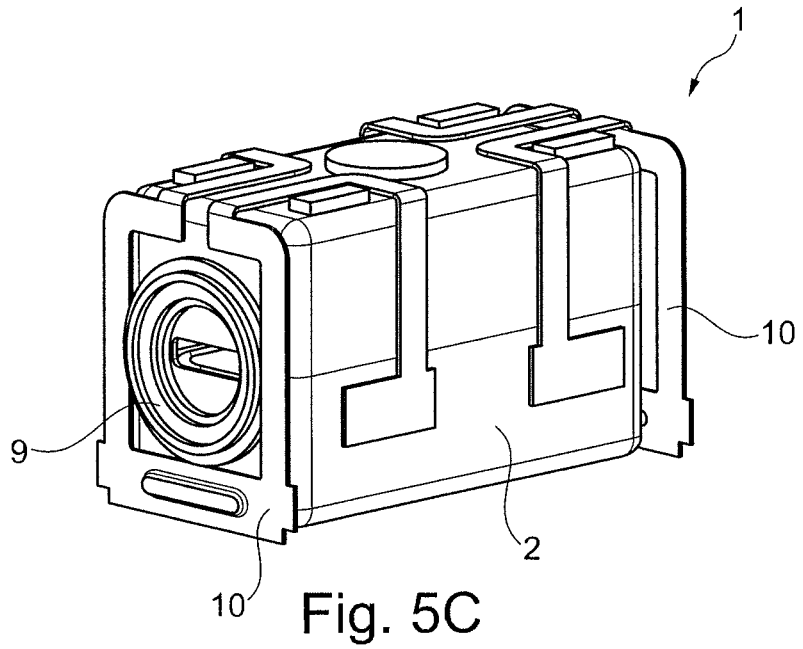

In FIG. 5B the lower section 3B of the assembly housing has been removed to get a better view of the receiver 2, the suspension structure 10, and the shock protection element 12. In FIG. 5C, both the upper and lower section 3A, 3B of the assembly housing has been removed.

Figure 5D:
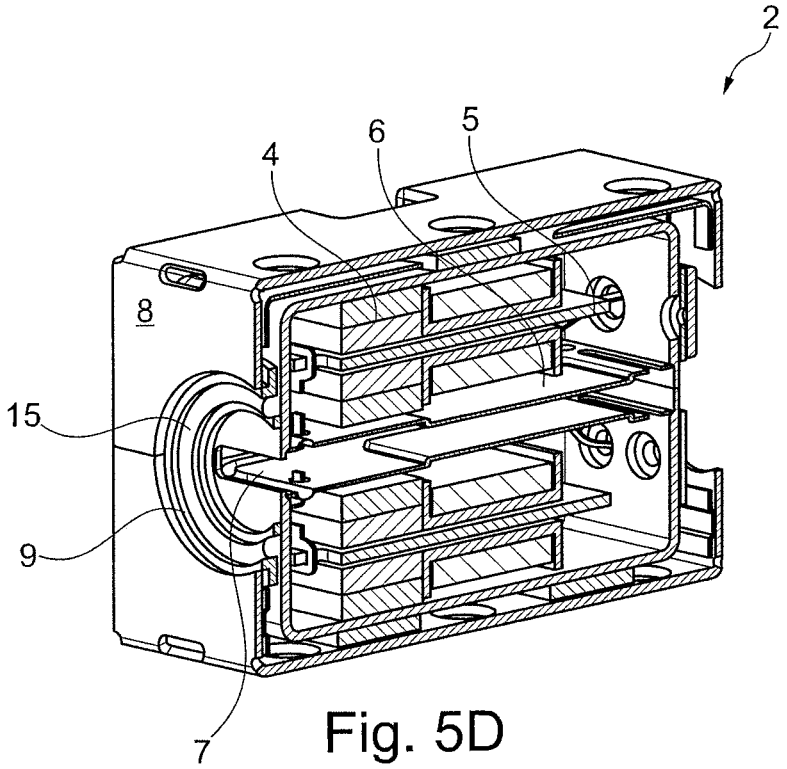

FIG. 5D illustrates a cross-section through the receiver 2. The receiver 2 comprises a magnet assembly 4, an armature 5, a diaphragm 6 being operationally attached to the armature, and a sound outlet 7 configured to outlet sound from the receiver 2.

The receiver assembly 1 comprises a vibration dampening element 15 connecting the sound outlet 7 and the assembly sound outlet 9. The vibration dampening element 15 is compliant to enable reduction of vibrations.

In the illustrated embodiment, the vibration dampening element 15 forms a sound channel from the sound outlet 7 to the assembly sound outlet. The vibration dampening element 15 is attached to the receiver 2 and to the assembly housing 3.

Figure 6A:
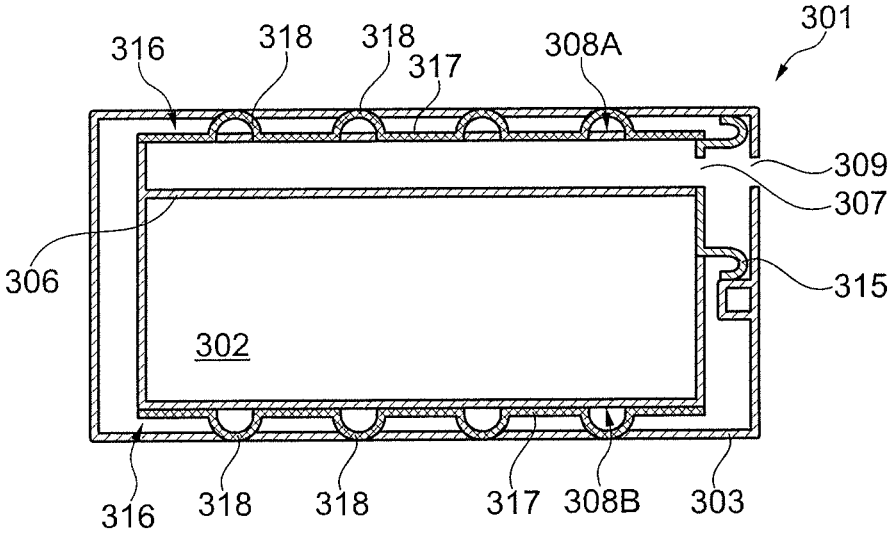
FIGS. 6A-6C illustrate different details of an embodiment of a receiver assembly.
Figure 6B:
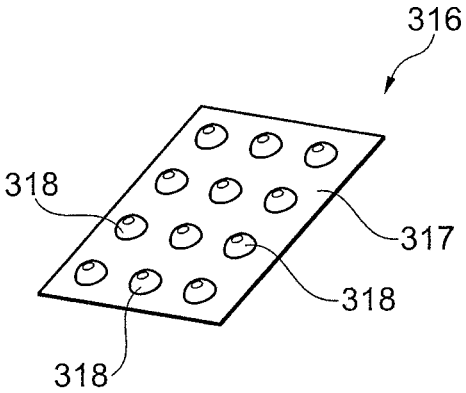
Figure 6C:
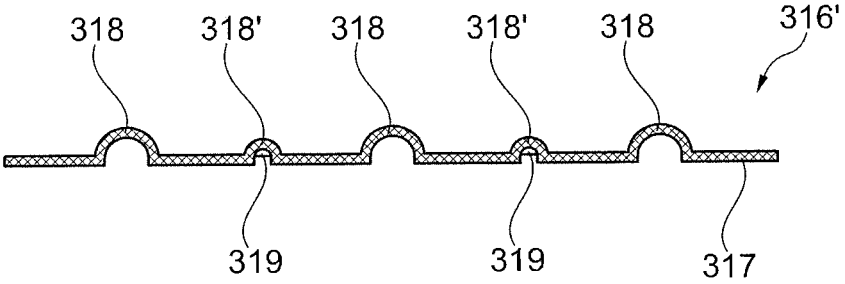

FIGS. 6A-6C illustrate different details of an embodiment of a receiver assembly 301. The receiver assembly 301 comprises a receiver 302 and an assembly housing 303.

The receiver 302 comprises a magnet assembly (not shown), an armature (not shown), a diaphragm 306 being operationally attached to the armature, and a sound outlet 307 configured to outlet sound from the receiver 302.

The assembly housing 303 comprises an assembly sound outlet 309 arranged in communication with the sound outlet 307 for outlet of sound from the receiver 302 via the assembly outlet 309.

The receiver assembly 301 comprises a vibration dampening element 315 connecting the sound outlet 307 and the assembly sound outlet 309. The vibration dampening element 315 is compliant to enable reduction of vibrations.

In the illustrated embodiment, the vibration dampening element 315 forms a sound channel from the sound outlet 307 to the assembly sound outlet. The vibration dampening element 315 is attached to the receiver 302 and to the assembly housing 303.

The receiver 302 comprises an outer surface 308. The receiver assembly 302 further comprises two compressible dampening elements 316 arranged between the outer surface 308 of the receiver 302 and an inner surface of the assembly housing 303 to dampen vibration of the receiver. It should be understood, that the compressible dampening elements 316 can be used in combination with a suspension structure as illustrated e.g. in FIG. 1.

The compressible dampening element 316 comprises a substantially flat base element 317 having a plurality of deformable protrusions 318 extending toward the inner surface of the assembly housing 302 and being in contact herewith.

The compressible dampening 316' element may further act as shock protection as illustrated by the embodiment of FIG. 6C. This is achieved by providing some of the protrusions 318' of a smaller height whereby there is no contact between the smaller protrusions 318' and the inner surface of the assembly housing 308. To improve the shock protecting effect, these smaller protrusions 318' are filled with a dampening material 319, such as a dampening gel or a foam.

Figure 7A:
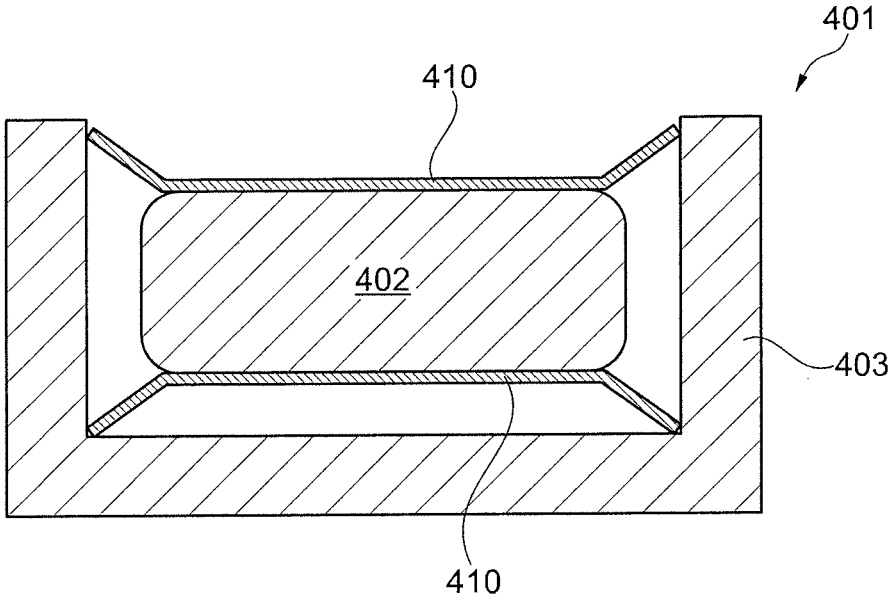
FIGS. 7A and 7B illustrate different embodiments of a receiver assembly.
Figure 7B:
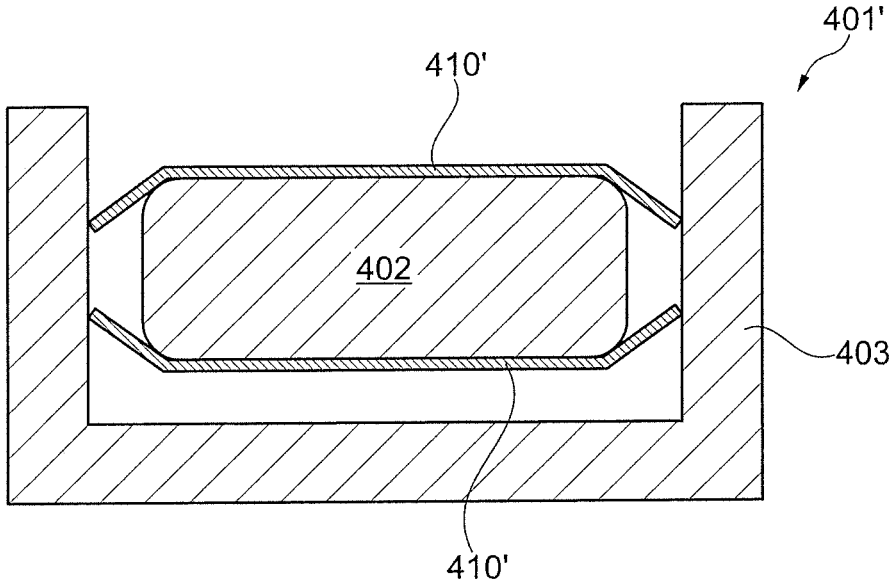

FIGS. 7A and 7B illustrate different embodiments of a receiver assembly 401, 410'. The receiver assembly 401, 401' comprises a receiver 402 and an assembly housing 403.

In the illustrated embodiment, the receiver assembly 401, 401' comprises a pre-tensioned element 410, 410' suspended between an outer surface of the receiver 402 and an inner surface of the assembly housing 403. When using a pre-tensioned suspension element 410, 410', the receiver 402 can be compliantly suspended. Furthermore, as the pre-tensioned element 410, 410' is substantially flat, it thereby only takes up little space in the assembly housing 302.

Figure 8:
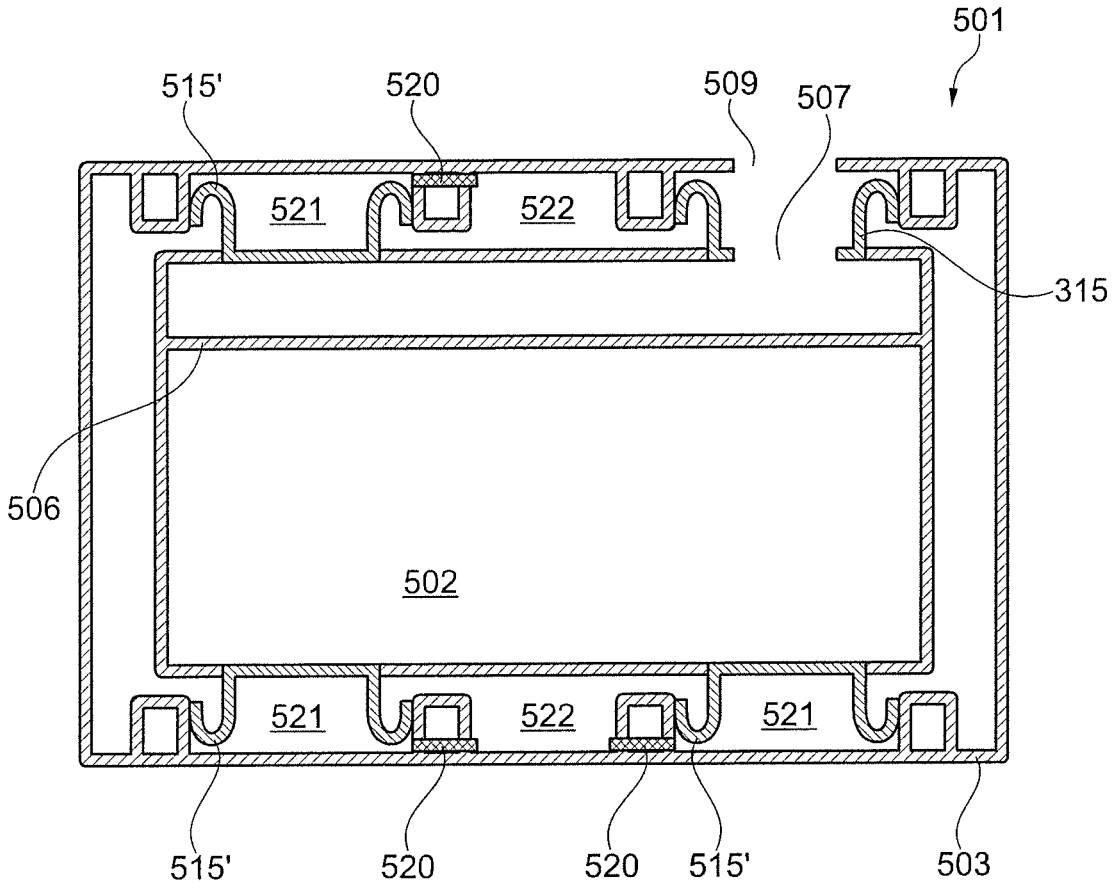
FIG. 8 illustrates an embodiment of a receiver assembly.

FIG. 8 illustrates an embodiment of a receiver assembly 501. The receiver assembly 501 comprises a receiver 502 and an assembly housing 503.

The receiver 502 comprises a magnet assembly (not shown), an armature (not shown), a diaphragm 506 being operationally attached to the armature, and a sound outlet 507 configured to outlet sound from the receiver 502.

The assembly housing 503 comprises an assembly sound outlet 509 arranged in communication with the sound outlet 507 for outlet of sound from the receiver 502 via the assembly outlet 509.

The receiver assembly 501 comprises a vibration dampening element 515 connecting the sound outlet 507 and the assembly sound outlet 509. The vibration dampening element 515 is compliant to enable reduction of vibrations.

In the illustrated embodiment, the vibration dampening element 515 forms a sound channel from the sound outlet 507 to the assembly sound outlet. The vibration dampening element 515 is attached to the receiver 502 and to the assembly housing 503.

The vibration dampening element 515 comprises a through hole allowing sound to propagate through the vibration dampening element.

Additionally, three suspension elements 515' are arranged in the assembly housing 503 and connect the receiver 502 and the assembly housing 503. The suspension elements 515' are similar to the vibration dampening element 515, however without a through hole. Due to the compliance of the suspension element 515', the receiver 502 is movable suspended in the assembly housing 503. It should be understood, that the suspension elements 515' can be used in combination with a suspension structure as illustrated e.g. in FIG. 1.

The suspension elements 515' are arranged so that they form a first and a second chamber 521, 522 in the assembly housing 503, as the suspension elements 515' contact both the inner surface of the assembly housing 503 and the outer surface of the receiver 502. To decrease the vibration peaks, the receiver assembly 501 further comprises three vents 520, each being arranged in communication with a first and a second chamber 521, 522.

FIGS. 9A-9D illustrate different embodiments of a receiver assembly 601. The receiver assembly 601 comprises a receiver 602 and an assembly housing 603.

The receiver 602 illustrated is movably suspended in the assembly housing 603 by a suspension structure 610, 610'.

Figure 9A:
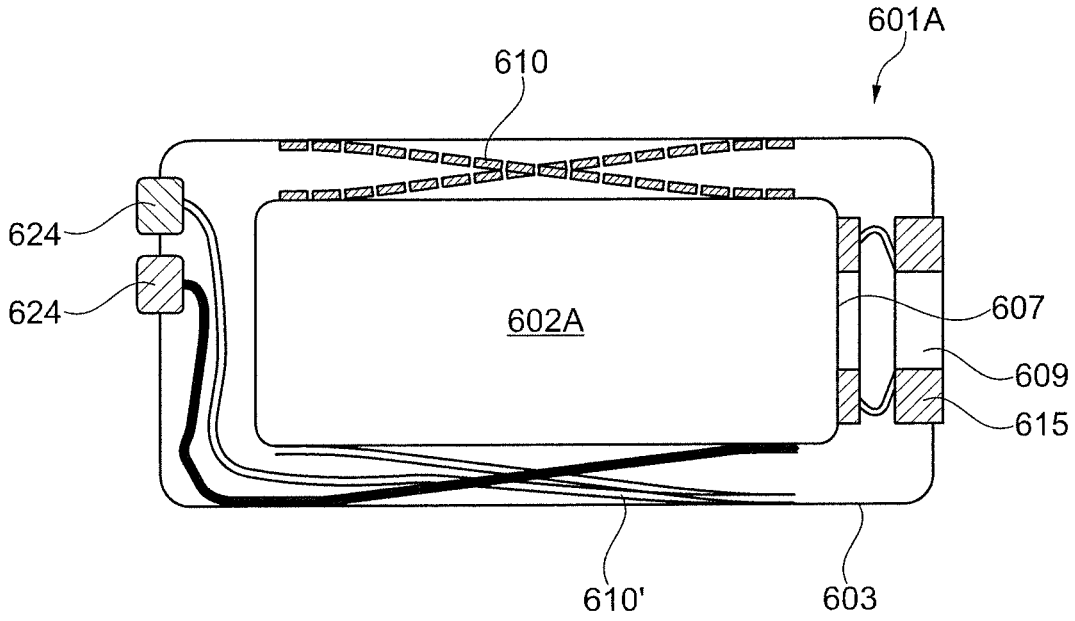
FIGS. 9A-9D illustrate different embodiments of a receiver assembly.
Figure 9B:
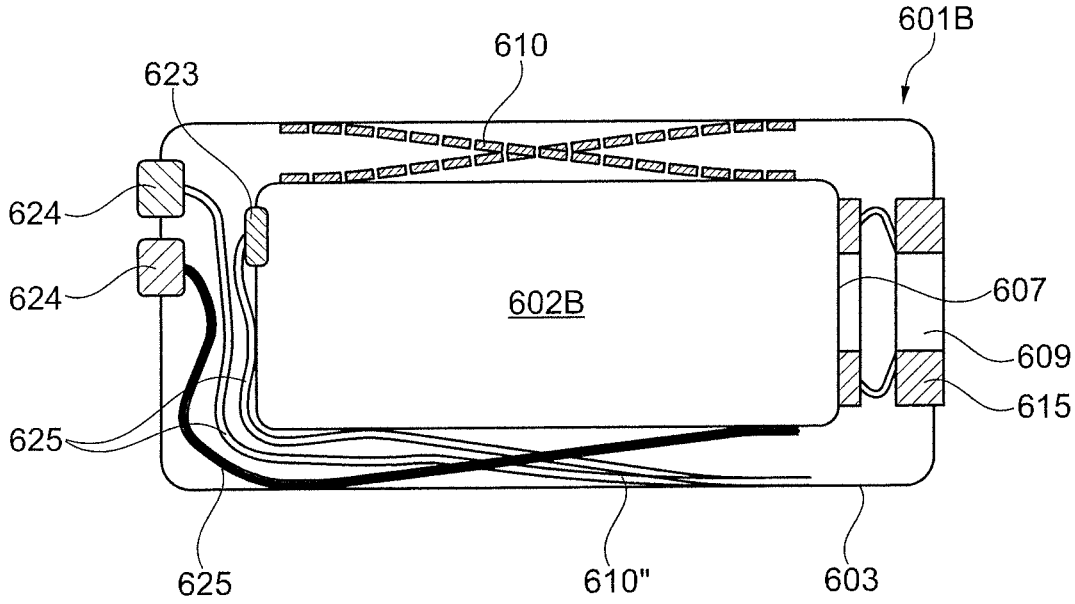

The suspension structure 610 schematically illustrated in FIGS. 9A and 9B may be identical to the suspension structure 10 illustrated in FIG. 1.

The suspension elements 610' are electrically conductive and are arranged between an electrical connector 623 of the receiver 602 and an electrical connector 624 of the assembly housing 603. In the illustrated embodiment, the electrically conductive suspension elements 610' are flex prints thereby enabling both mechanical and electrical connection between the receiver 602 and the assembly housing 603.

In FIG. 9A, the receiver 602A is suspended by a non-conductive suspension structure 610 and a conductive suspension structure 610' which electrically connects the receiver 602A to the assembly housing 603.

In FIG. 9B, the receiver 602B is suspended by a non-conductive suspension structure 610 and a conductive suspension structure 610". The conductive suspension structure 610" is electrically connected to the assembly housing 603 by traditional wires 625.

Figure 9C:
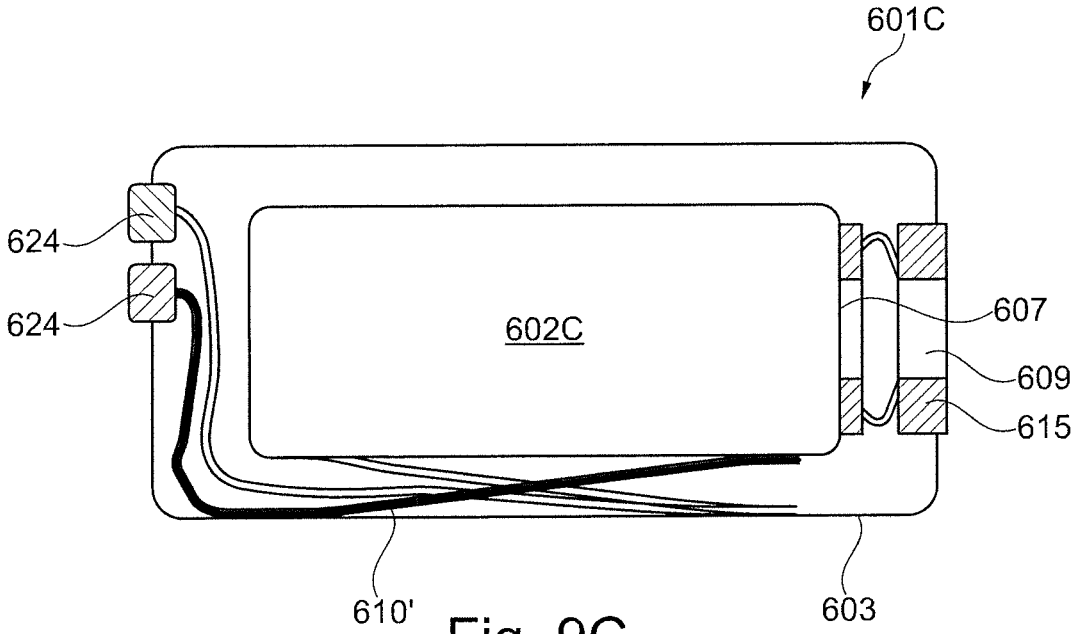

In FIG. 9C, the receiver 602C is suspended by a conductive suspension structure 610' which electrically connects the receiver 602C to the assembly housing 603.

Figure 9D:
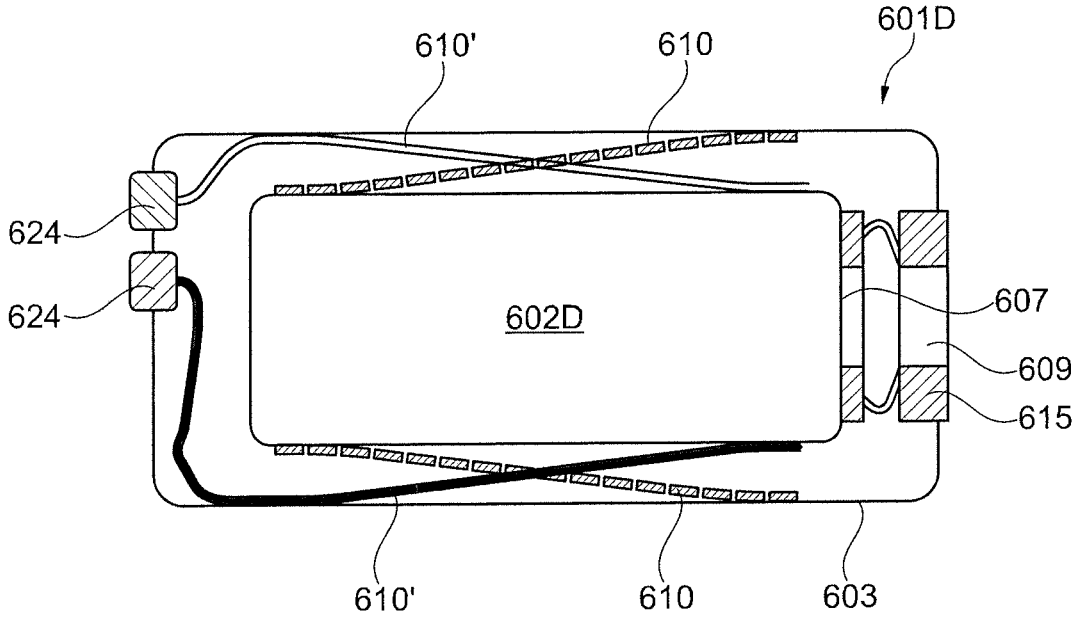

In FIG. 9D, the receiver 602D is suspended by two non-conductive suspension structure 610 and two conductive suspension structure 610' which electrically connects the receiver 602D to the assembly housing 603.

The receiver assembly 601A, 601B, 601C, 601D comprises a vibration dampening element 615 connecting the sound outlet 607 and the assembly sound outlet 609. The vibration dampening element 615 is compliant to enable reduction of vibrations. In the illustrated embodiment, the vibration dampening element 615 forms a sound channel from the sound outlet 607 to the assembly sound outlet.

Figure 10:
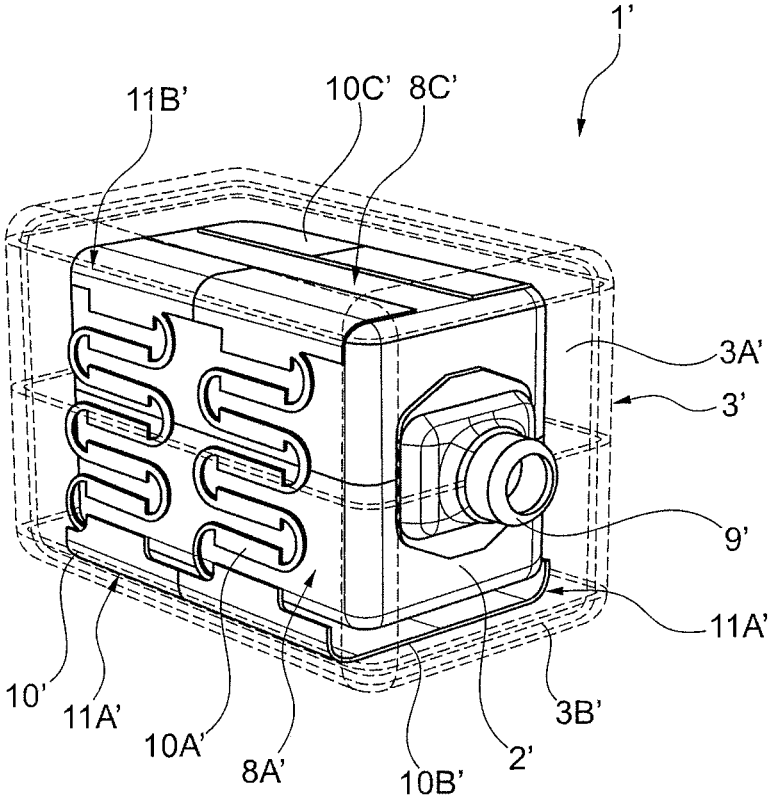
FIG. 10 illustrates an alternative embodiment of a receiver assembly.
Figure 11B:
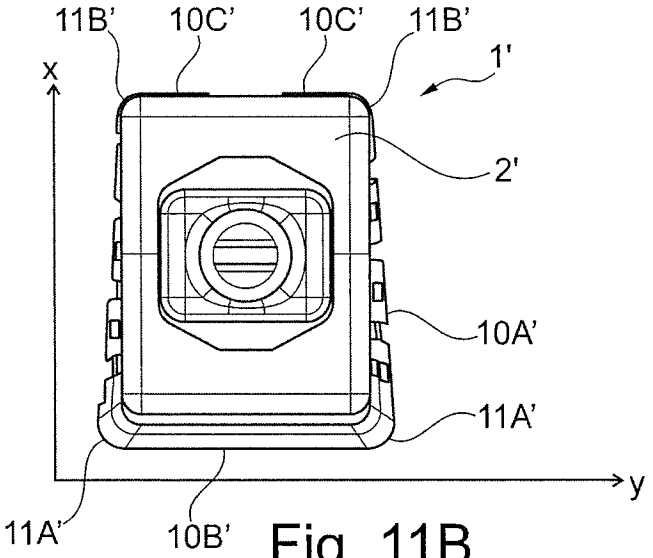
FIGS. 11A-11C illustrate details of the embodiment illustrated in FIG. 10.
Figure 11C:
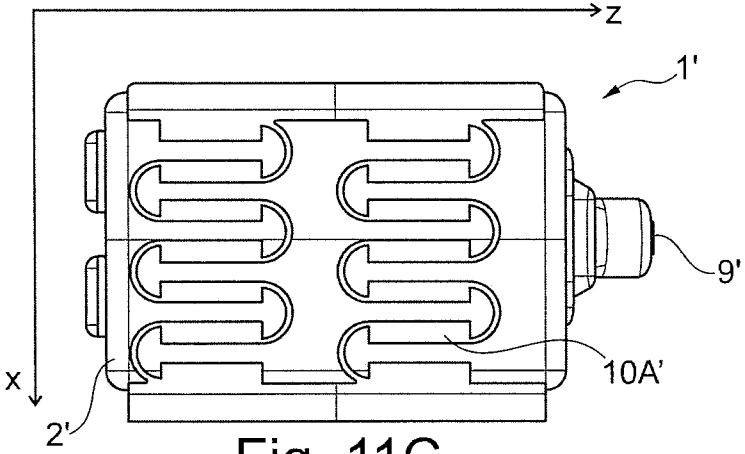
Figure 11A:
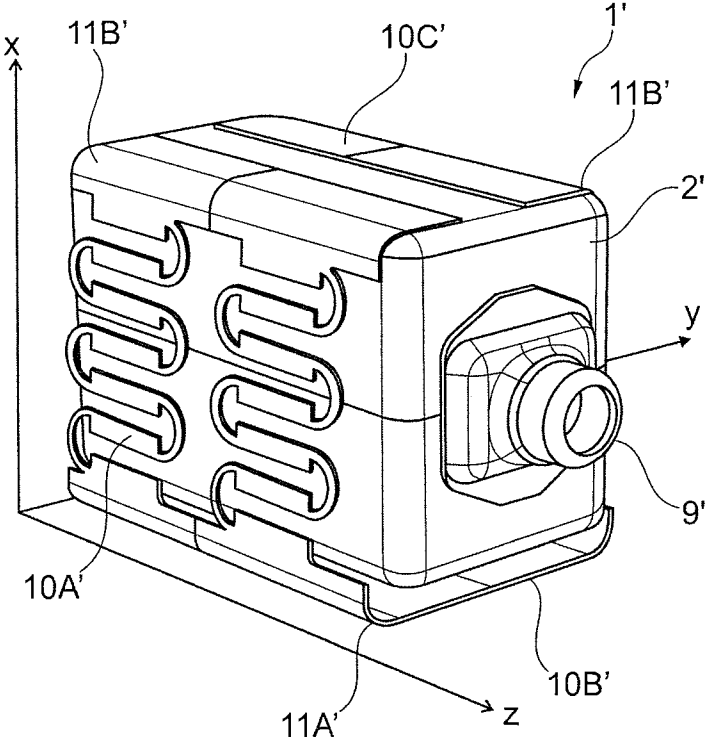

FIG. 10 illustrates an embodiment of a receiver assembly 1' similar to the embodiment illustrated in FIG. 1 and FIG. 5. FIGS. 11A-11C illustrate details of the suspension structure 10'.

The receiver assembly 1' comprises a receiver 2' and an assembly housing 3'. The assembly housing 3' is formed by an upper section 3A' and a lower section 3B'.

The receiver 2' comprises an outer surface 8'; i.e. at least a first 8A', a second outer surface 8B', and a third outer surface 8C'. The receiver 8' is arranged at least partly within the assembly housing 3.

The assembly housing 3' comprises an assembly sound outlet 9' arranged in communication with the sound outlet (not shown) for outlet of sound from the receiver 2' via the assembly outlet 9'.

The receiver assembly 1' further comprises a suspension structure 10' comprising suspension elements 10'A, 10'B, 10'C. The suspension structure 10' suspends the receiver 2' in the assembly housing 3'.

Each suspension element 10' is an elongated element extending in a longitudinal direction and is configured to dampen vibration of the receiver 2' by deflection of the suspension element 10' in a direction transverse to the longitudinal direction.

As illustrated, the elongated suspension element 10' may comprise additional elements transverse to the elongated part.

In the illustrated embodiment, the suspension structure 10' forms four bent sections 11' whereby a first suspension element 10A' is arranged between the first outer surface 8A' and an inner surface of the assembly housing 3', a second suspension element 10B' is arranged between the second outer surface 8B' and an inner surface of the assembly housing, and third the suspension element 10C' is arranged between a third outer surface 8C' and an inner surface of the assembly housing 3'. The first 10A' and second 10B' suspension elements extend in different directions from the bent part 11A', whereas the first 10A' and third 10C' suspension elements extend in different directions from the bent part 11B'.

The illustrated suspension structure 10' thereby forms a 3D structure having a trapezoidal shape enabling dampening of vibration in three different directions relative to the receiver 2'. Due to the trapezoidal shape of the suspension structure, see FIG. 11A, vibrations can be isolated in the Z direction.

The first suspension element 10A' is arranged between the first outer surface 8A' and an inner surface of the assembly housing 3'. As illustrated in FIG. 11B, an identical suspension element 10A' is arranged at the opposite side of the receiver 2'. The suspension elements 10A' are arranged in contact with the outer surface of the receiver 2' at the upper end point (see FIG. 11B) and in contact the an inner surface of the assembly housing 3' at the other end point; i.e. at the bent section 11A'. Thus, the distance from the suspension element 10A' to the receiver 2' varies along length of the suspension element.

As illustrated in FIG. 11A and 11C, the first suspension element 10A' comprises a two substantially identical set of wave-shaped elements. By providing this dual system twisting of the suspension structure 10' around the Y axis may be avoided or at least considerably decreased.

The second suspension element 10B' is arranged between the second outer surface 8B' and an inner surface of the assembly housing 3'. In the illustrated embodiment, this part of the suspension structure is substantially parallel to the bottom of the receiver 2' and in contact with the lower inner surface of the assembly housing.

The third suspension element 10C' is arranged between a third outer surface 8C' and an inner surface of the assembly housing 3'. In the illustrated embodiment, this part of the suspension structure is substantially parallel to the upper surface 8C' of the receiver 2' and in contact with this upper surface.

By providing the suspension structure 10' so that the third suspension element 10C' is in contact with the upper surface 8C' and so that the second suspension element 10B' is in contact with the opposite lower inner surface of the assembly housing 3', the suspension structure 10' is self-supporting and works in all directions. I.e. the suspension structure 10' will be able to dampen vibrations independent of the direction of gravity and can thus be turned upside down without affecting the dampening possibilities hereof.

The invention claimed is:

1. A receiver assembly comprising a receiver and an assembly housing;

the receiver comprising a sound outlet configured to outlet sound from the receiver and at least a first and a second outer surface and being arranged at least partly within the assembly housing, the assembly housing comprising an assembly sound outlet arranged in communication with the sound outlet for outlet of sound from the receiver via the assembly outlet, the receiver assembly further comprising a suspension structure comprising at least one suspension element, the suspension structure suspending the receiver in the assembly housing, wherein the at least one suspension element connects the receiver and the assembly housing, the at least one suspension element being formed by a sheet material and being an elongated element extending in an longitudinal direction and being configured to dampen vibration of the receiver by deflection of the suspension element in a direction transverse to the longitudinal direction, the receiver assembly further comprising a shock protection element arranged in the assembly housing, the shock protection element having a higher compliance than the suspension element.

2. A receiver assembly according to claim 1, wherein the suspension structure forms a bent section whereby a first suspension element is arranged between the first outer surface and an inner surface of the assembly housing and a second suspension element is arranged between the second outer surface and an inner surface of the assembly housing, the first and second suspension elements extending in different directions from the bent part.

3. A receiver assembly according to claim 2, wherein the suspension structure forms a second bent section so that a third suspension element is arranged between a third outer surface of the receiver and an inner surface of the assembly housing.

4. A receiver assembly according to claim 1, wherein a cross-section of the elongated element is non-uniform along at least a part of elongated element in the longitudinal direction.

5. A receiver assembly according claim 1, further comprising a deformable element arranged between the suspension element and the receiver whereby the suspension element contacts the receiver at least partly via the deformable element.

6. A receiver assembly according to claim 1, wherein a protrusion is formed on the first outer surface or the second outer surface, and wherein the suspension element contacts the receiver at least partly at the protrusion.

7. A receiver assembly according to claim 1, further comprising a vibration dampening element connecting the sound outlet and the assembly sound outlet.

8. A receiver assembly according to claim 7, wherein the vibration dampening element seals a passage between an outer surface of one sound outlet and the assembly sound outlet and an inner surface of the other one of the sound outlet and the assembly sound outlet.

9. A receiver assembly according to claim 1, further comprising a compressible dampening element arranged between an outer surface of the receiver and an inner surface of the assembly housing, and wherein the compressible element comprises a substantially flat base element having a plurality of deformable protrusions extending toward at least one of an outer surface of the receiver and an inner surface of the assembly housing.

10. A receiver assembly according to claim 1, further comprising a pre-tensioned element suspended between an outer surface of the receiver and an inner surface of the assembly housing.

11. A receiver assembly according to claim 1, wherein the suspension elements forms at least a first and a second chamber in the assembly housing, the receiver assembly further comprising a vent arranged in communication with the first and second chamber.

12. A receiver assembly according to claim 1, wherein at least one of the suspension elements is electrically conductive and arranged between an electrical connector of the receiver and an electrical connector of the assembly housing.

13. A personal audio device comprising a receiver assembly according to claim 1, wherein the receiver is configured to generate sound whereby it vibrates within a frequency range of 10 Hz-20 kHz, and wherein the at least one suspension element is configured to deflect to thereby dampen vibration of the receiver.

14. A receiver assembly according to claim 2, wherein a cross-section of the elongated element is non-uniform along at least a part of elongated element in the longitudinal direction.

15. A receiver assembly according to claim 3, wherein a cross-section of the elongated element is non-uniform along at least a part of elongated element in the longitudinal direction.

16. A receiver assembly according claim 2, further comprising a deformable element arranged between the suspension element and the receiver whereby the suspension element contacts the receiver at least partly via the deformable element.

17. A receiver assembly according to claim 16, further comprising a vibration dampening element connecting the sound outlet and the assembly sound outlet.

18. A receiver assembly according to claim 2, further comprising a compressible dampening element arranged between an outer surface of the receiver and an inner surface of the assembly housing.

19. A receiver assembly comprising a receiver and an assembly housing;

the receiver comprising a sound outlet configured to outlet sound from the receiver and at least a first and a second outer surface and being arranged at least partly within the assembly housing, the assembly housing comprising an assembly sound outlet arranged in communication with the sound outlet for outlet of sound from the receiver via the assembly outlet, the receiver assembly further comprising a suspension structure comprising at least one suspension element, the suspension structure suspending the receiver in the assembly housing, wherein a protrusion is formed on the first outer surface or the second outer surface, and wherein the suspension element contacts the receiver at least partly at the protrusion.

20. A receiver assembly comprising a receiver and an assembly housing;

the receiver comprising a sound outlet configured to outlet sound from the receiver and at least a first and a second outer surface and being arranged at least partly within the assembly housing, the assembly housing comprising an assembly sound outlet arranged in communication with the sound outlet for outlet of sound from the receiver via the assembly outlet, the receiver assembly further comprising a suspension structure comprising at least one suspension element, the suspension structure suspending the receiver in the assembly housing, wherein the suspension elements forms at least a first and a second chamber in the assembly housing, the receiver assembly further comprising a vent arranged in communication with the first and second chamber.

* * * * *